US011767696B2

(12) United States Patent
Gaastra

(10) Patent No.: US 11,767,696 B2
(45) Date of Patent: Sep. 26, 2023

(54) ASSEMBLY COMPRISING A HOUSING WITH A BALANCING SPRING BREAK PROTECTION MECHANISM FOR A DOOR SYSTEM SUCH AS A SECTIONAL DOOR SYSTEM AND A DOOR SYSTEM INCLUDING THE ASSEMBLY

(71) Applicant: ASSA ABLOY ENTRANCE SYSTEMS AB, Landskrona (SE)

(72) Inventor: Jildert Gaastra, Zwolle (NL)

(73) Assignee: Assa Abloy Entrance Systems, Landskrona (SE)

( * ) Notice: Subject to any disclaimer, the term of this patent is extended or adjusted under 35 U.S.C. 154(b) by 799 days.

(21) Appl. No.: 16/631,813

(22) PCT Filed: Aug. 2, 2018

(86) PCT No.: PCT/EP2018/070961
§ 371 (c)(1),
(2) Date: Jan. 16, 2020

(87) PCT Pub. No.: WO2019/025522
PCT Pub. Date: Feb. 7, 2019

(65) Prior Publication Data

US 2020/0165852 A1 May 28, 2020

(30) Foreign Application Priority Data

Aug. 4, 2017 (SE) ..... 1730203-5

(51) Int. Cl.
*E05D 13/00* (2006.01)
*E06B 3/48* (2006.01)

(52) U.S. Cl.
CPC ..... *E05D 13/1261* (2013.01); *E05D 13/1269* (2013.01); *E05Y 2600/13* (2013.01);
(Continued)

(58) Field of Classification Search
CPC ..... E05D 13/1253; E05D 13/1261; E05D 13/1269; E05Y 2600/13; E05Y 2900/106; E06B 9/62; E06B 9/80; E06B 3/485
See application file for complete search history.

(56) References Cited

U.S. PATENT DOCUMENTS 5,494,093 A 2/1996 Eiterman
8,793,933 B2 * 8/2014 Peterse ..... E05F 5/00 160/291
(Continued)

FOREIGN PATENT DOCUMENTS

DE 3300331 5/1984
DE 19855697 A1 * 2/2000 ..... E05D 13/003
(Continued)

OTHER PUBLICATIONS

International Search Report and Written Opinion mailed in PCT/EP2018/070961 dated Nov. 29, 2018.
SE Search Report mailed in 1730203-5 dated Feb. 22, 2018.

*Primary Examiner* — Abe Massad
*Assistant Examiner* — Jeremy C Ramsey
(74) *Attorney, Agent, or Firm* — Wissing Miller LLP

(57) ABSTRACT

The invention relates to an assembly (1) comprising a housing with a balancing spring break protection mechanism, said assembly (1) being configured for connecting a connector (15, 42), such as a bayonet connector, of a balancing spring of a sectional door system to said assembly, said housing being for connection with a fixed structure and comprising a first housing plate (5) comprising an opening (16) for receiving a balancing axle (60) of said sectional door system, said balancing axle (60) being connected to said balancing spring, and an aperture (11) for receiving said connector (15, 42), said spring break protection mechanism comprising a bearing and ratchet wheel unit (4, 7), said
(Continued)

ratchet wheel (4) including a shaft (50) for receiving said balancing axle (60).

16 Claims, 11 Drawing Sheets

(52) U.S. Cl.
CPC ... *E05Y 2900/106* (2013.01); *E05Y 2900/132* (2013.01); *E06B 3/485* (2013.01)

(56) References Cited

U.S. PATENT DOCUMENTS

| | | | |
|---|---|---|---|
| 2002/0069585 | A1 | 6/2002 | Schiks |
| 2006/0137138 | A1 | 6/2006 | Mullet |
| 2006/0185800 | A1 | 8/2006 | Beaudoin |
| 2006/0231217 | A1 | 10/2006 | Martin |

FOREIGN PATENT DOCUMENTS

| | | | | |
|---|---|---|---|---|
| EP | 0151427 | | 8/1985 | |
| EP | 1213428 | A1 * | 6/2002 | ..... E05D 13/1269 |
| EP | 1760251 | | 3/2007 | |
| EP | 1892360 | | 2/2008 | |
| EP | 2669456 | | 12/2013 | |
| FR | 2349024 | | 11/1977 | |
| WO | WO-8501543 | A * | 4/1985 | ..... E05D 13/1269 |

* cited by examiner

ASSEMBLY COMPRISING A HOUSING WITH A BALANCING SPRING BREAK PROTECTION MECHANISM FOR A DOOR SYSTEM SUCH AS A SECTIONAL DOOR SYSTEM AND A DOOR SYSTEM INCLUDING THE ASSEMBLY

This application is a 371 of PCT/EP2018/070961 filed on Aug. 2, 2018, published on Feb. 7, 2019 under publication number WO 2019/025522, which claims priority benefits from Swedish Patent Application No. 1730203-5 filed on Aug. 4, 2017, the disclosure of which is incorporated herein by reference.

TECHNICAL FIELD OF THE INVENTION

The present invention relates generally to a spring break mechanism for a door system, such as a sectional door system, and more particularly to an assembly comprising a housing with a balancing spring break protection mechanism, said assembly being configured for connecting a bayonet connector of a balancing spring of such a door system.

DESCRIPTION OF THE RELATED ART

In overhead doors torsion springs, generally two springs per door, are used to balance out the total weight of the door leaf, so the door can be opened with ease. If the door is (partly) open and one of the springs breaks, the system gets out of balance, which will cause the door leaf to fall with force. This can lead to dangerous situations. In case of only one torsion spring, the danger is even higher.

To avoid these dangerous situations usually a torsion spring is connected to a so-called spring break device (SBD), i.e. a safety mechanism that is arranged to stop the fall of the door leaf if the spring breaks or fails. At the end of the torsion spring a bayonet connector with a plug/pin is typically attached which is arranged to be connected to a wall plate of the SBD. Installing the plug to the SBD involves a lot of handling. A mechanic needs to remove nuts, usually two, from fixation points on the base plate using two wrenches. He will then have to position the plug on the fixation points, and next, place the two nuts on fixation points and tighten them using two wrenches at a time.

EP 2669456 discloses an assembly comprising a housing with a balancing spring break protection mechanism, the assembly being configured for connecting a connector, such as a bayonet connector, of a balancing spring of a sectional door system to the assembly, the housing being for connection with a fixed structure and comprising a first housing plate comprising an opening for receiving a balancing axle of the sectional door system, the balancing axle being connected to the balancing spring, and an aperture for receiving the connector, the spring break protection mechanism comprising a bearing and ratchet wheel unit, the ratchet wheel including a shaft for receiving the balancing axle, the shaft being connectable with the balancing axle for rotation therewith, a pawl pivotably journaled inside the housing, the pawl being pivotable between a first position in which the ratchet wheel is free-running and a second position in which a pin of the pawl engages the ratchet wheel; wherein if the connector is rotated the pawl moves into the second position for the engagement with the ratchet wheel so as to limit or prevent rotation thereof.

One problem with the prior art assemblies is that dust and dirt may settle within the mechanism, possibly limiting proper operation thereof. Also, the known SBD's need to be dimensioned to immediately take up energy from the falling door.

SUMMARY

It is an object of the present invention to provide an assembly with a novel spring break mechanism and a door system having the new spring break mechanism.

According to a first aspect of the invention the housing of the assembly further comprises a second housing plate arranged opposite the first housing plate and connected therewith, the second housing plate comprising an opening receiving the shaft, the ratchet wheel being between the first and second housing plates, the pin of the pawl having a pin head extending through a first pin head opening in the first housing plate and/or in the second housing plate.

By providing a second housing plate arranged opposite the first housing plate and the first housing plate being connected to the second housing plate a stronger construction is achieved. Further, the providing of a second housing plate comprising an opening for mounting the bearing of the bearing and ratchet wheel unit with the ratchet wheel being between the first and second housing plates achieves that the internal part functionality of the structure is to a more limited degree affected by external factors, such as e.g. dirt or solid objects. The two-part construction, with the bearing mounted in the second housing plate, is also advantageous in terms of maintenance.

The assembly may in one embodiment include housing plate portions defining a deformation zone yielding by a force applied by the pin head moving in the first pin head opening upon continued rotation of the ratchet wheel engaged by the pawl. The deformation allows for some continued rotation of the ratchet wheel, thereby gradually absorbing energy from a falling sectional door. In one embodiment the housing plates may include a number of further pin head openings defining the deformation zone, wherein portions of the first housing plate and/or of the second housing plate separating the pin head openings from each other will break by the pin head moving from one of the pin head openings into another one of the pin head openings upon the continued rotation of the ratchet wheel engaged by the pawl. Alternatively, the first pin head opening may be formed as an elongated passage tapering to one end such that the pin head will seek to expand the passage as it moves into portions thereof having a width smaller than the cross-wise dimension of the pin head.

A problem associated with the prior art is that users sometimes have reinstalled—previously activated—spring break protection mechanisms. This has been a source of serious risks since the great forces at stake when the protection mechanisms are activated destroys—with very high probability—the future functionality of the protection mechanism, however often without visible sign. Such mistakes are very effectively prevented by the present invention, partly because previous activation can clearly be seen on broken material between the pawl pin head openings and partly because the pawl cannot be reused as it is deformed once the security mechanism has been used.

Further preferred embodiments of the invention are defined in the dependent claims.

DETAILED DESCRIPTION OF EMBODIMENTS

The present invention will now be described with reference to the figures, in which like reference labels are used to refer to like elements throughout the figures.

Figure 1:
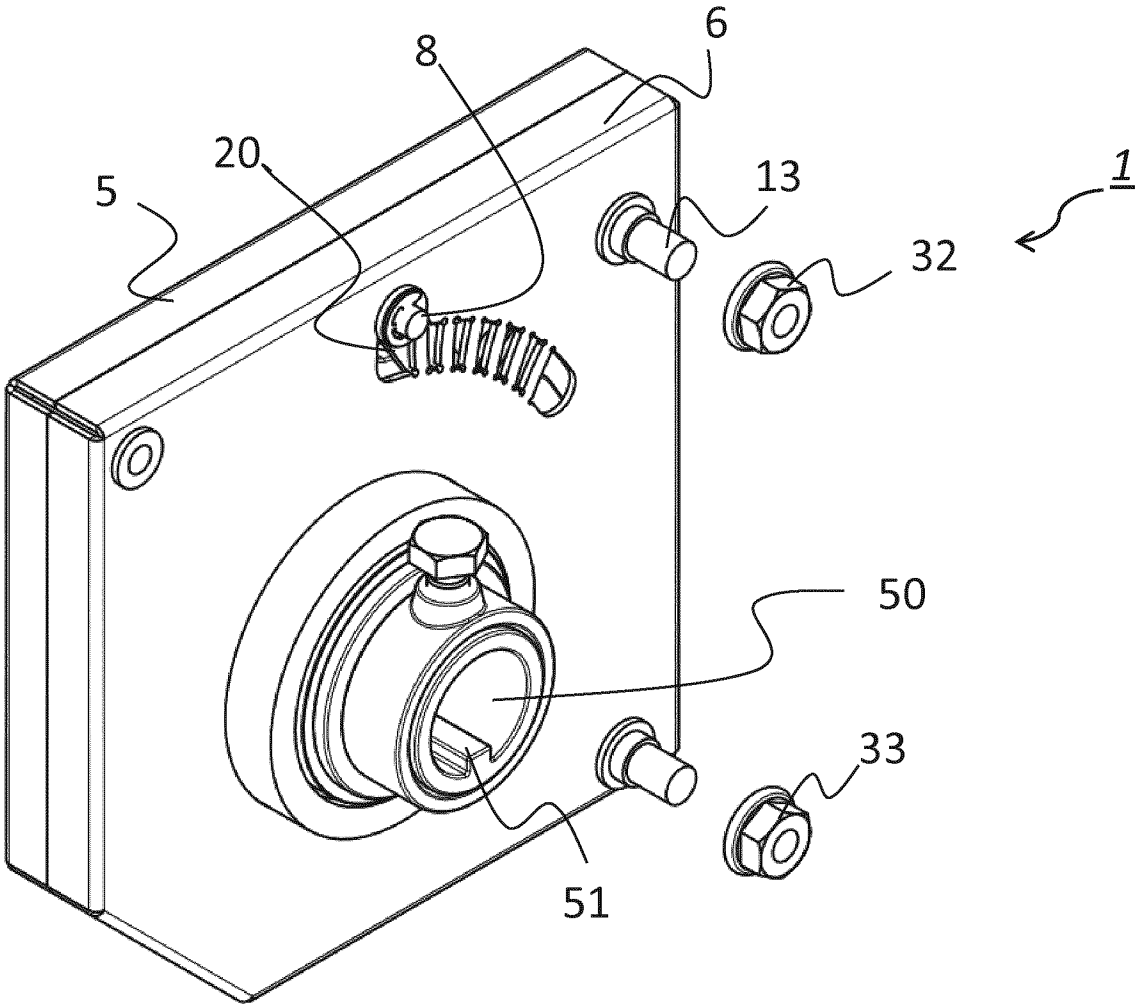
FIG. 1 shows a perspective view of an embodiment of an assembly of the invention, with a pawl of a spring break protection mechanism thereof in an inactivated configuration, and with one type of deformation zone.

FIG. 1 is a perspective view of an embodiment of an assembly 1 of the present invention, with a balancing spring break protection mechanism.

Sectional door systems, or similar door systems such as screen doors, are often provided with a balancing axle connected with the door and rotating as the door is raised and lowered, a balancing spring being on the one hand connected with the balancing axle and on the other hand with a fixed structure. Such balancing springs are often provided with a balancing spring break protection mechanism, see by way of example EP 2 669 456, which serves to lock or restrain the balancing axis against rotation if the balancing spring breaks or otherwise fails, by the balancing spring being indirectly connected with the fixed structure via the balancing spring break protection mechanism. Absent such a mechanism the sectional door would keep falling on failure of the balancing spring, representing a potential hazard.

Figure 4:
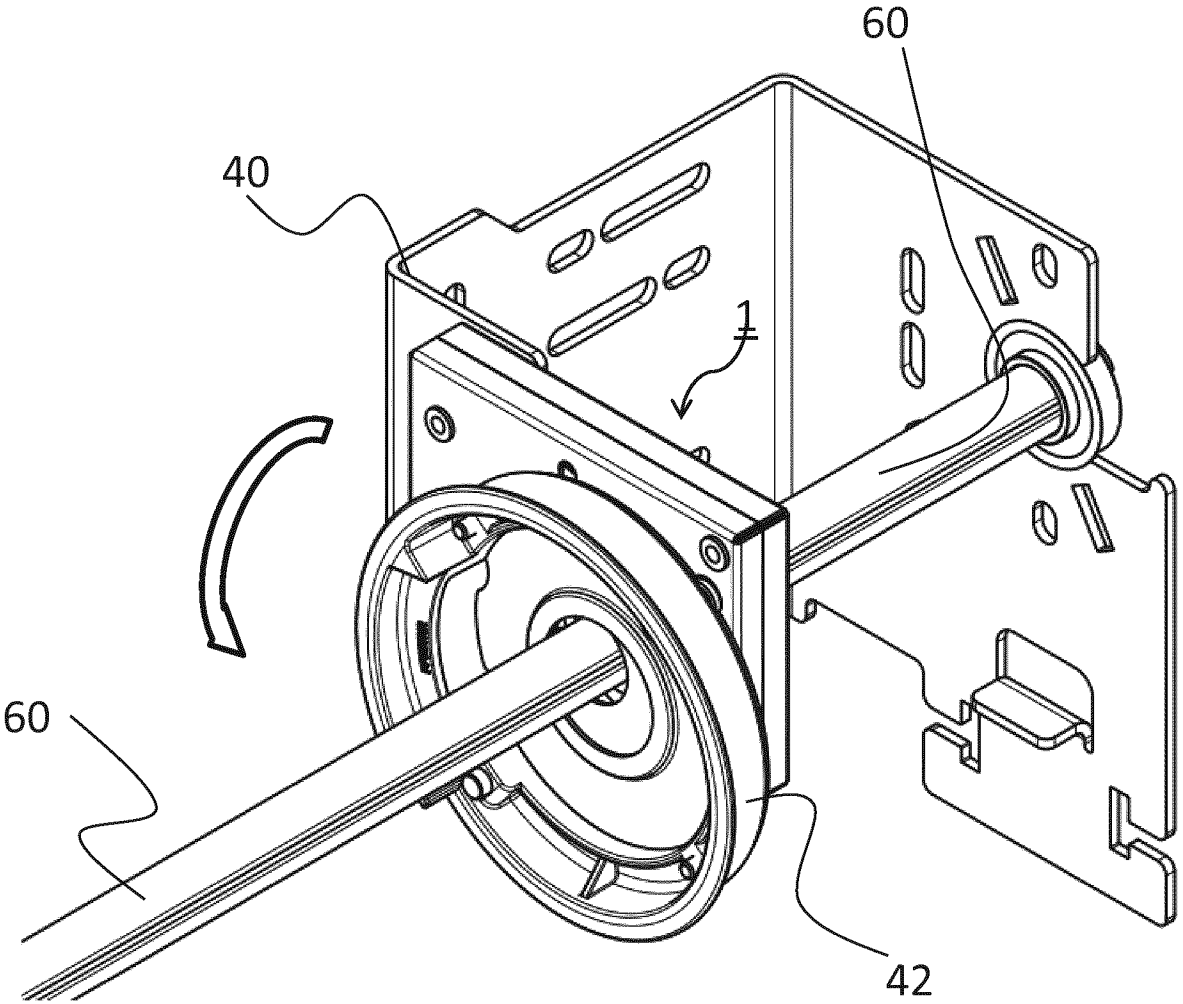
FIG. 4 shows a perspective view of the assembly of FIG. 1 together with a mounting plate, in a mounted state showing also a balancing axle carrying a balancing spring connector.

The shown assembly 1 comprises a housing with a first housing plate 5 and an opposite second housing plate 6, each formed from metal sheet and comprising a central opening 16 for receiving the balancing axle 60 of a sectional door system, as shown in FIG. 4. The spring break protection mechanism comprises a bearing and ratchet wheel unit, the ratchet wheel 4 having a plurality of teeth and being connectable with the balancing axle for rotation therewith during use of the sectional door system.

Figure 6:
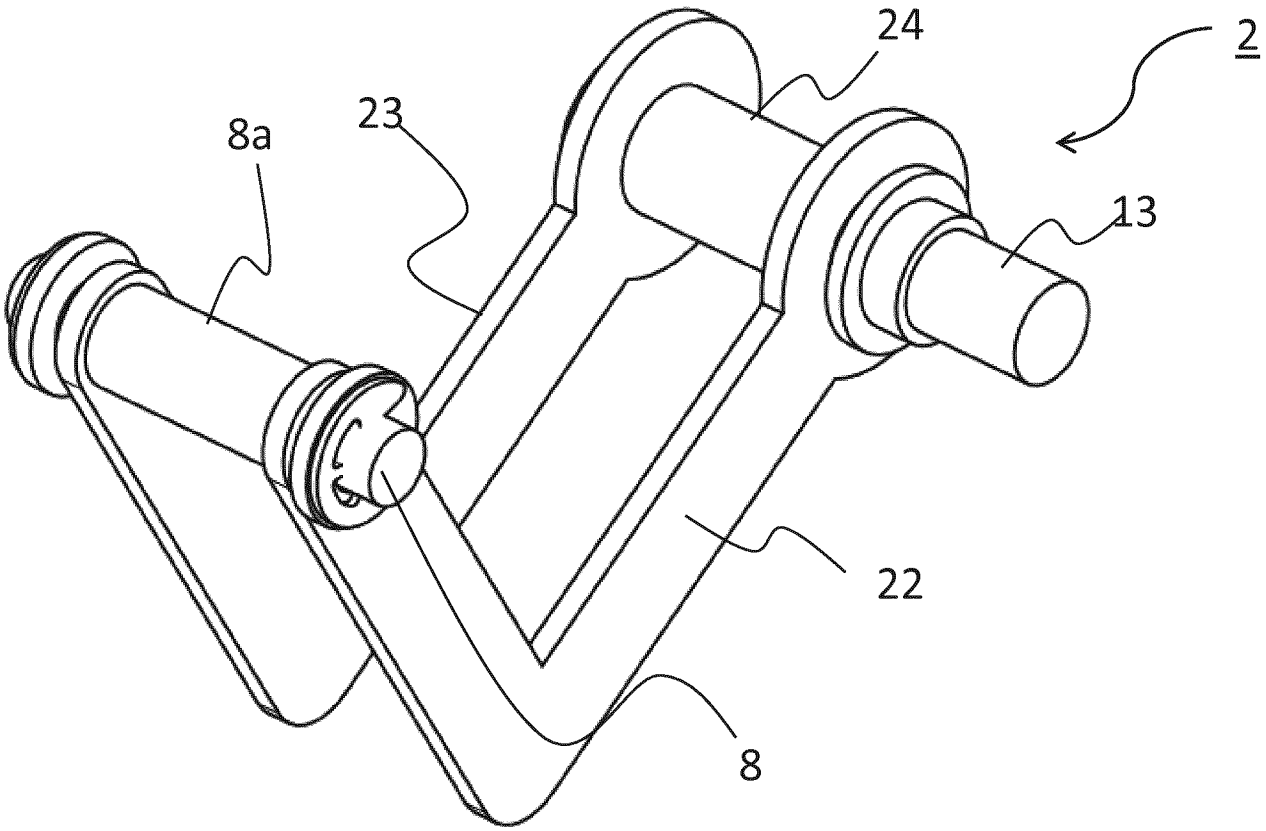
FIG. 6 shows a perspective view of an embodiment of a pawl of the spring break mechanism.

Inside the housing and pivotally connected thereto is a pawl 2 including a pin 8*a* with respective ends or heads 8, each extending through or received by a corresponding opening or slot 20 in one of the housing plates 5, 6. FIG. 6 shows the pawl 2 in more details. The pawl comprises two identical plates 22, 23 arranged spaced apart, parallel and joined by two sections 24 and 8*a*, the latter defining the aforementioned pin 8*a* which is configured for engagement with the teeth of the ratchet wheel 4. The pawl 2 is mounted so that the pawl 2 can rotate about a shaft/pivot 13 which may be a part of a bolt connection 32, 34 as shown in e.g. FIG. 1, connecting the two housing plates 5, 6. A pawl spring 14 shown in FIG. 2 is preferably positioned around the shaft/pivot of the paw 2.

Shown in FIG. 4 is a connector 42 including a pin with a head 15 (see FIG. 2) arranged against the first housing plate 5; a balancing spring (not shown) wound around the axle 60 is connected with the connector 42. Via the connector 42 is one end of the balancing spring connected with the assembly 1. The assembly 1 as such is mounted to a mounting plate 40 connected to a fixed structure (not shown) by means of bolts.

Figure 2:
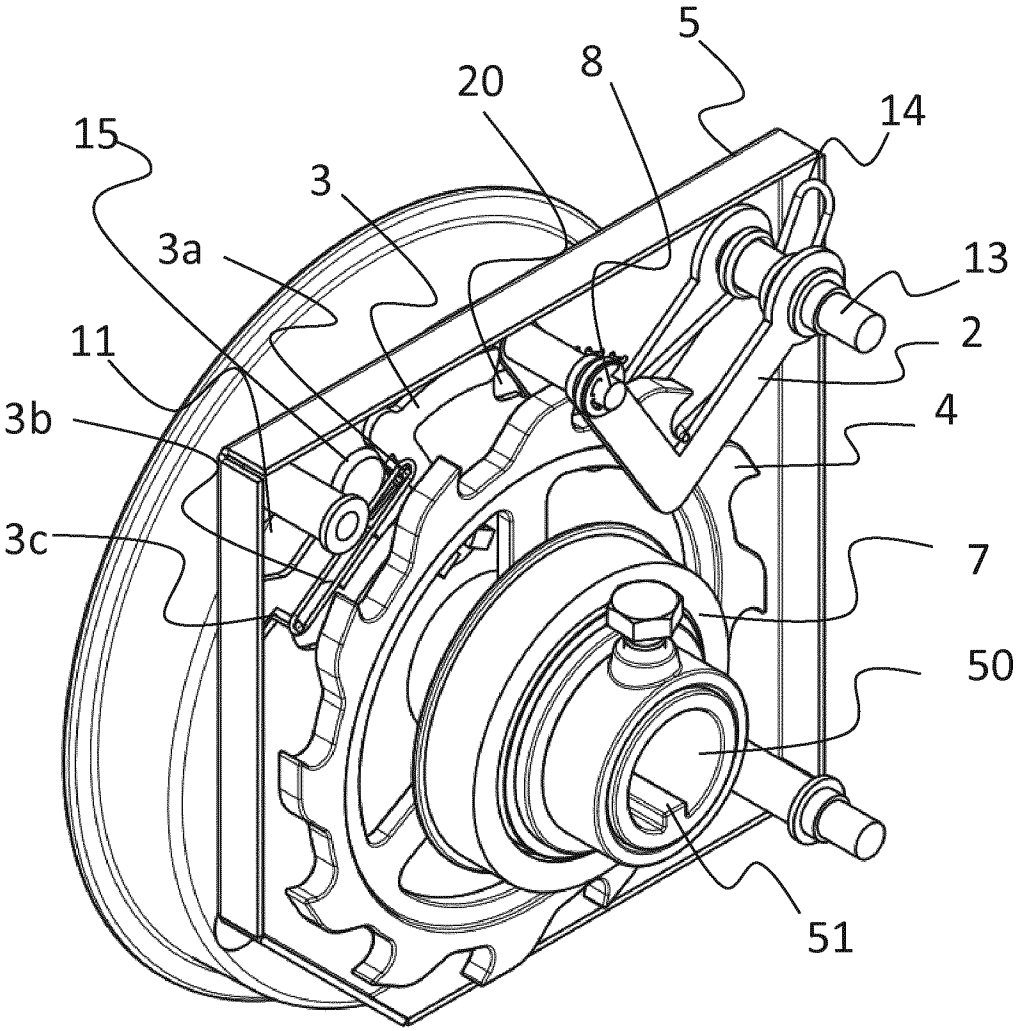
FIG. 2 shows a perspective view of a first housing plate and a bearing and ratchet wheel unit of the assembly of FIG. 1, in the inactivated configuration of the spring break protection mechanism.

In FIG. 2 is shown in perspective view the first housing plate 5 and the pawl 2 pivotably connected to the first housing plate 5 by means of a pivot pin 13, and biased by means of a pawl spring 14. One head 8 of the pin 8*a* of the pawl 2 extends through the aforementioned slot 20 beyond the first housing plate 5 while the opposite head 8 of the pin 8*a* of the pawl 2 in a like manner extends beyond the second housing plate 6, as shown in FIG. 1. The bearing and ratchet wheel unit 4,7 which is connected to the second plate 6 comprises a shaft with a passage 50 for receiving the balancing axle 60 of the sectional door system (not shown). The ratchet wheel 4 is engaged with the balancing axle 60, such as by the shaft 50 having a projection 51 engaging a groove of the axle 60. Alternatively, or additionally, the connection can by using a screw 25 engaging with the balancing axle 60.

As shown the connector 42 comprises a disc-shaped structure with a central axle 60 receiving hole larger in size than the diameter of the axle 60. Each of the first and second housing plates 5, 6 has two apertures 11,12 through which respective projecting parts, one preferably being a plug/pin with an enlarged head 15, of the connector 42 may be inserted into the housing to connect therewith, such as through a bayonet action involving a slight rotation of the connector 42 relative to the axle 60 in the direction indicated by the arrow shown in FIG. 4. Only one such aperture 11 of the first plate 5 is shown in FIG. 2, the other aperture 12 of the first plate 5 being shown in FIG. 3. One aperture 11 of the aforementioned two apertures 11, 12 has an enlarged portion sized to receive the enlarged head 15 and being contiguous with a narrow slot.

When the connector 41 plug extends in the narrow slot after the aforementioned rotation of the connector 42 the head 15 thereof bears against a blocking plate 3 acting as a pawl and to be described below, which blocking plate maintains the pawl 2 in a position as shown in FIG. 2, representing the inactivated configuration of the spring break protection mechanism wherein the ratchet wheel 4 is free-running. FIG. 2 represents an assembly 1 configuration during normal use of the door system.

Figure 5:
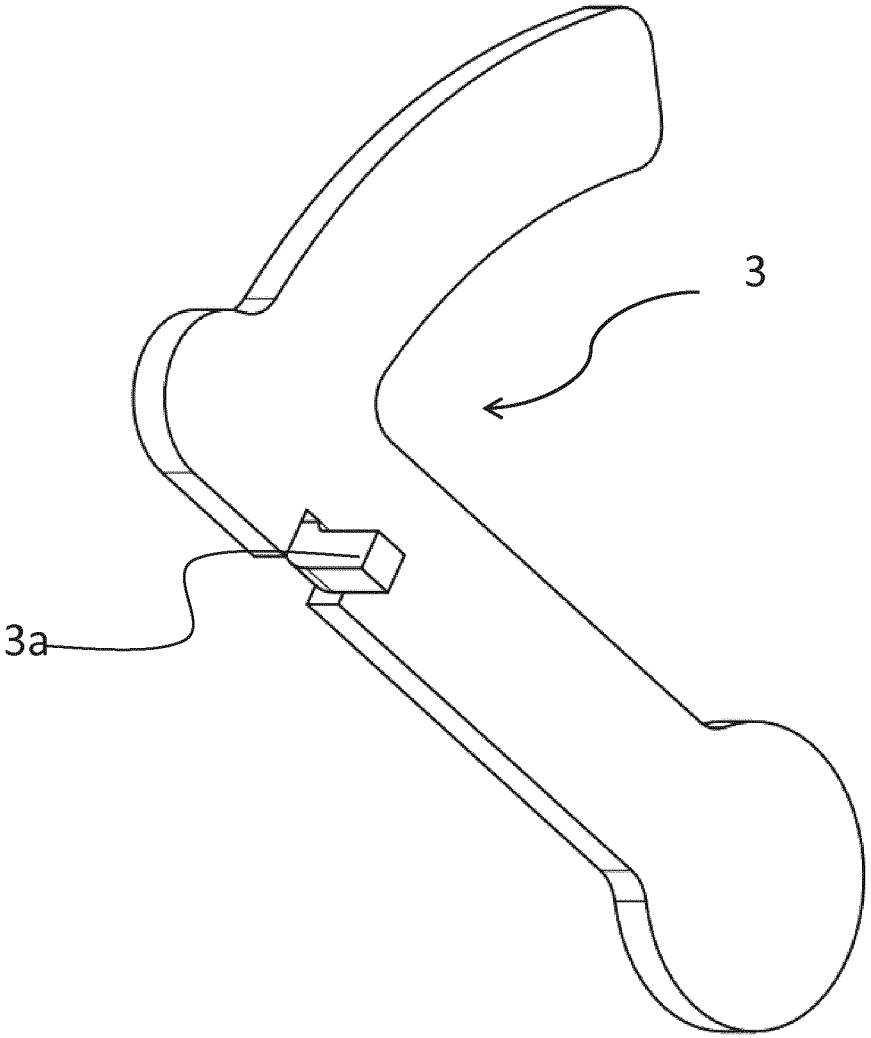
FIG. 5 shows a perspective view of an embodiment of a blocking plate of the spring break mechanism.
Figure 8:
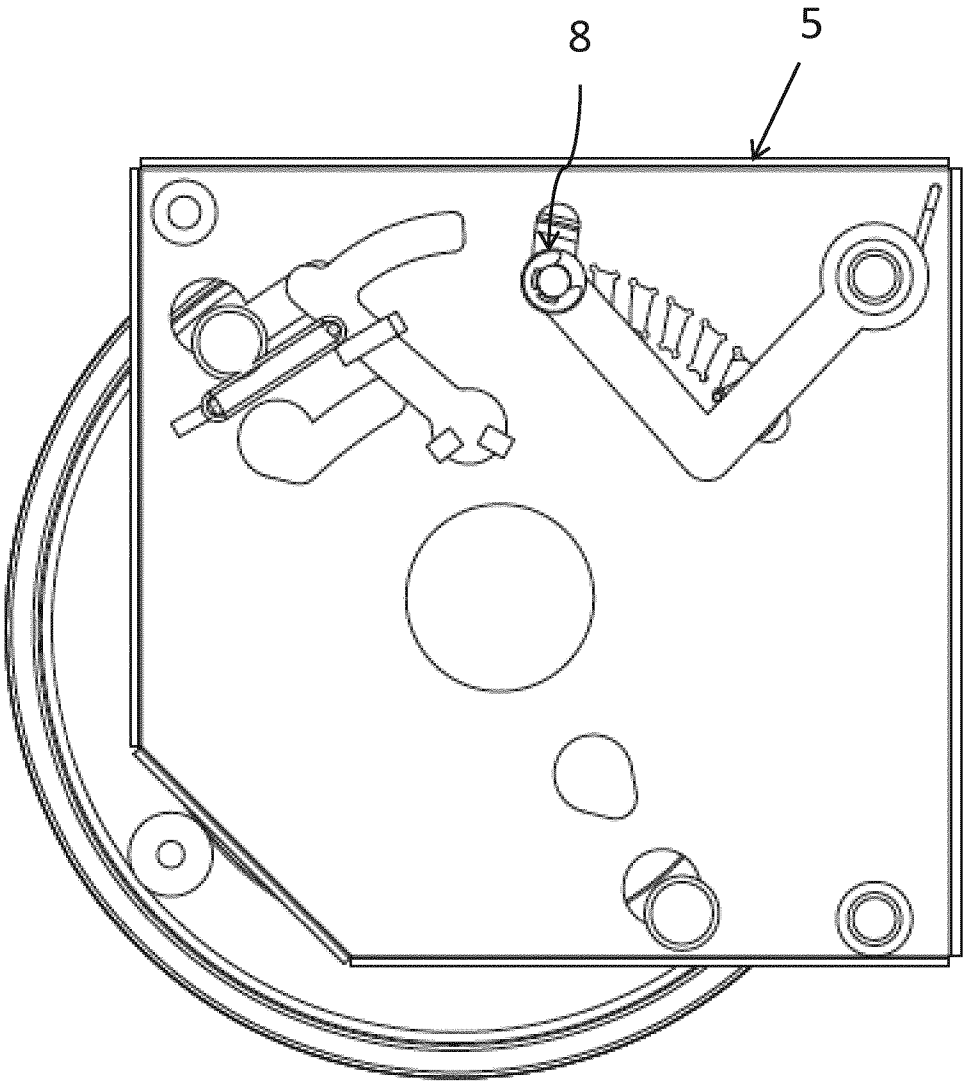
FIG. 8 is a view similar to FIG. 7, showing the mechanism in the activated configuration.

The blocking plate 3, as best seen in FIGS. 2 and 5, is provided with a protruding portion 3*a* and acts as a pawl by being pivotably arranged in the housing to allow it to turn in a counter-clockwise direction from the position shown in FIG. 2 to a second position, also referred to herein as a release position, where an upper portion thereof is closer to the enlarged portion of the aperture 11, see FIG. 8. This movement to the release position may be brought about through the action of a spring 3*c* engaging protruding portions 3*a*, 3*c* of the blocking plate 3 and the first housing plate 5 respectively.

When the connector 42 is not being biased by the balancing spring, as may happen in case of balancing spring failure, the connector 42 will no longer hold the position of the connector plug with the head 15 thereof within the narrow slot portion of the aperture 11; on rotation of the connector 42 the connector plug moves towards the enlarged portion of the aperture 11.

As a consequence the blocking plate 3, driven by spring 3*c*, assumes its release position shown in FIG. 8 in which the blocking plate 3 no longer acts against the pawl 2. This allows the pawl 2 to then turn anti-clockwise, driven by the pawl spring 14, into the position shown in FIG. 8, which represents the activated configuration of the spring break protection mechanism wherein the pawl 2 pin 8*a* engages the ratchet wheel 4. This engagement prevents or restricts rotation of the balancing axle 60 connected with the sprocket wheel 4 and, hence, restricts or blocks movement of the sectional door that would otherwise result from the failure of the balancing spring.

Figure 7:
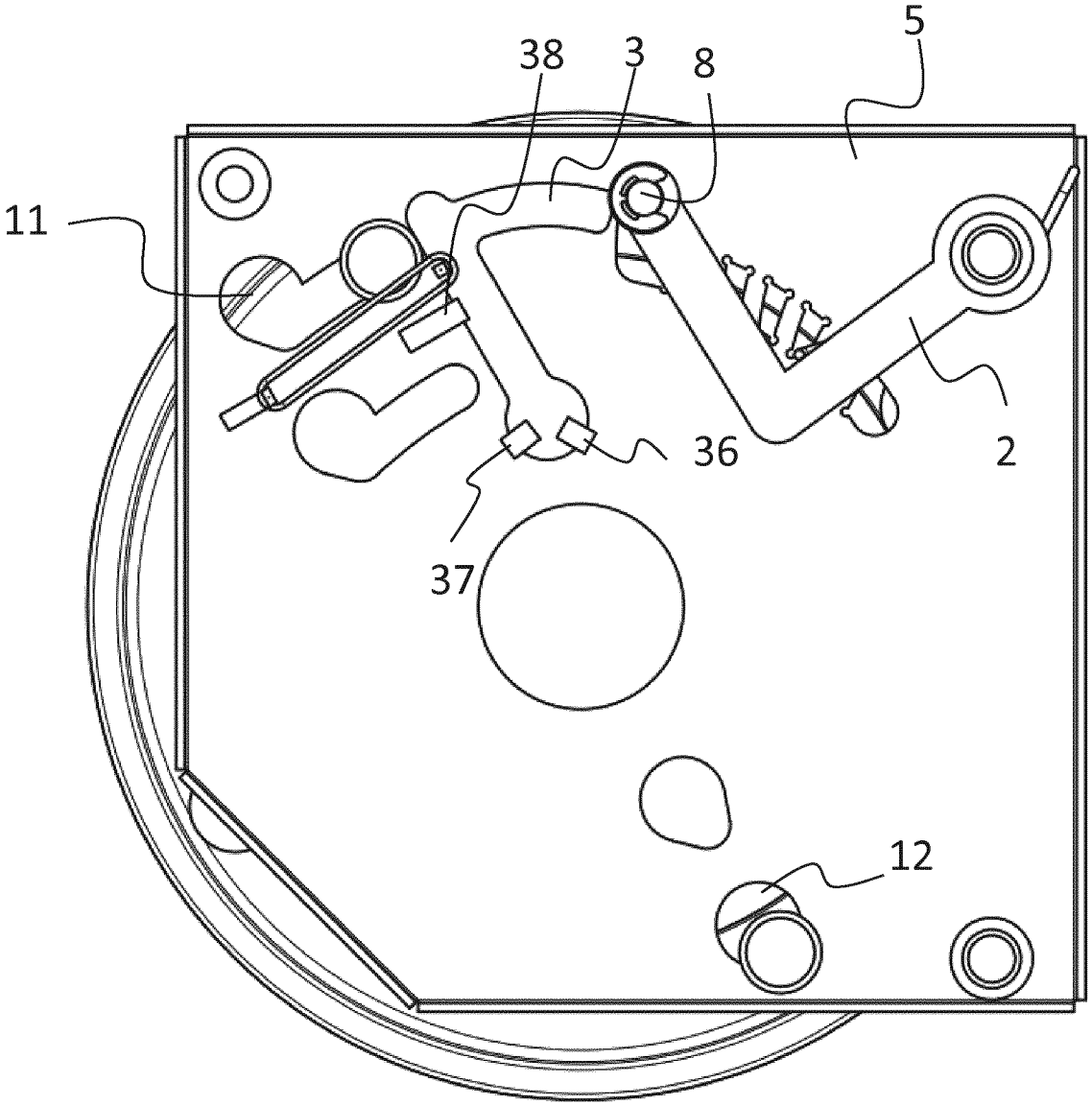
FIG. 7 is a front view of the first housing plate and balancing spring connector, with the blocking plate, pawl and springs mounted thereto.

The blocking plate 3 shown in FIG. 5 is in the shown embodiment rotatably connected to the first housing plate 5 by being mounted in adapted holders 36, 37 and 38, as shown in FIG. 7, in the first housing plate 5. The back of the holders which—in the illustrated embodiment—are portions punched out from the first housing plate 5 can be seen as openings in FIG. 3 with reference numbers 36*a*, 37*a* and 38*a*. However, the blocking plate 3 may by rotatably connected to the housing by other means as e.g. a bearing/pin connection or other means known to the skilled person.

Figure 3:
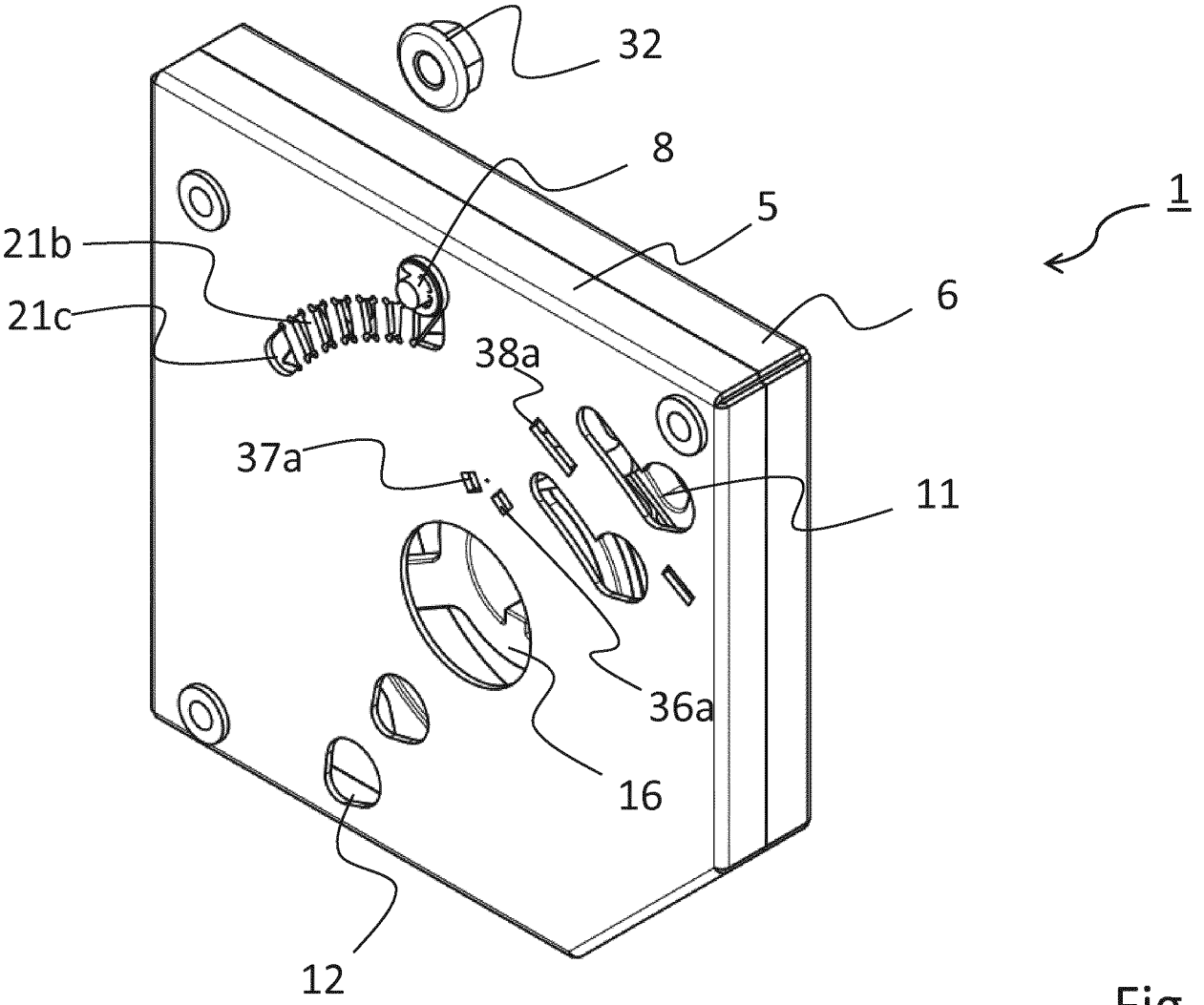
FIG. 3 shows a perspective view of the opposite side of the assembly of FIG. 1.

FIG. 3 is a perspective view of the other side of the embodiment of a spring break protection mechanism 1, as seen in FIG. 1. The first and second housing plates 5,6 can be joined together by bolts nut joints 32, 33 so that inwardly bent flanges of the housing plates 5, 6 contact each other whereby the housing plates 5, 6 define an enclosure for the spring break mechanism. The housing thereby may not only form a sealed structure preventing ingress of dust and dirt but also may serve to effectively transfer forces to a fixed building structure via the mounting plate 40 shown in FIG. 4.

As mentioned, a central opening 16 formed in the first housing plate 5 is opposite to a similar central opening 16 formed in the second housing plate 6. The central openings 16 receive the balancing axle of the sectional door system extending through the housing. In the top left/middle of the first housing plate 5, next to slot 20 is a series of openings 21*b* formed along a path, see FIGS. 1 and 3, in the shown embodiment along a path resembling a portion of the perimeter of an imaginary circle; the openings 21*b* are disposed opposite corresponding openings in the second housing plate 6. The multiple openings 21*b* act to define a deformation zone; when the pawl 2 pin is brought into engagement with the ratchet wheel 4, which is driven to rotation by the falling sectional door, the pawl 2 pin heads 8 are driven from the first position shown in FIG. 8 in slot 20, breaking through the metal sheet material separating the openings 21*b*. Thus, the rotation of the ratchet wheel 4 and, hence, of the balancing axle, gradually slows until it stops when the pin head 8 reaches the end 21*c* of the series of openings 21*b*. In the embodiment of FIG. 8 the aforementioned action will give rise to a deformation of the plates 22, 23 of the pawl 2 whereby they will assume a V-shape rather than the L-shape shown in FIG. 8, thereby relying also on the deformability of the pawl 2; alternatively, the series of opening 21*b* may be arranged along an arc of a circle having a centre at the point around which the pawl 2 pivots.

Figure 9:
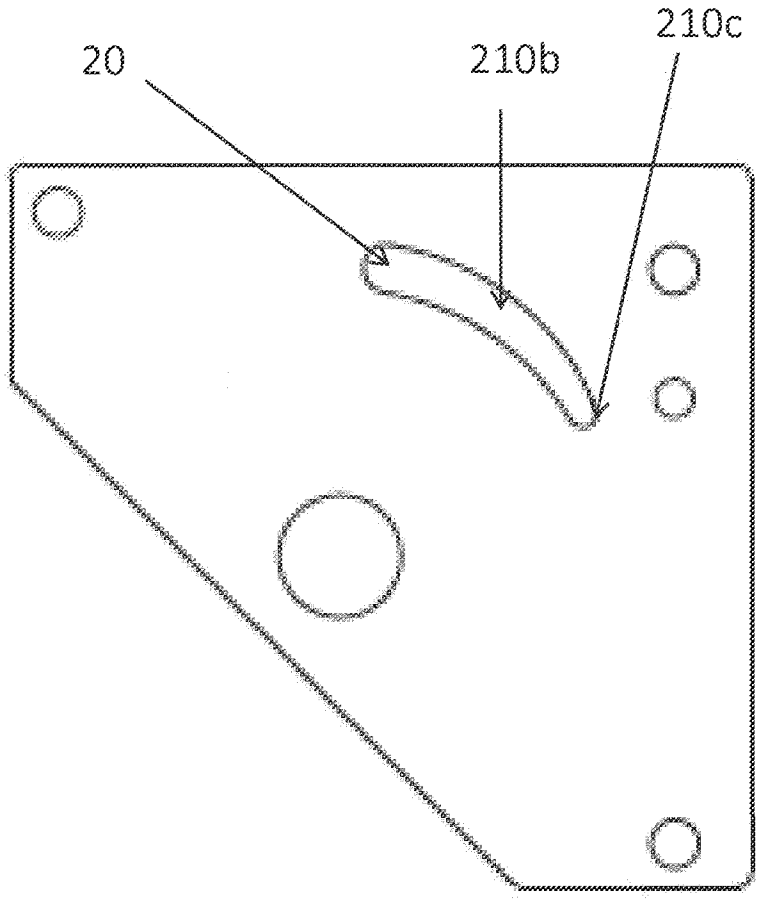
FIG. 9 is a front view of the housing plate having an alternative type of deformation zone.

As will be understood, the deformation preferably allows for some continued rotation of the axle 60, thereby gradually absorbing energy from a falling sectional door. FIG. 9 shows an alternative configuration of the housing plate deformation zone, here referenced generally by numeral 210*b*, where the first pin head opening 20 is formed contiguous with an elongated passage 210*b* tapering towards one end 210*c* such that the pin head (not shown) will seek to deform/expand the passage 210*b* as it moves into portions thereof having a width smaller than the cross-wise dimension of the pin head 8.

Figure 10:
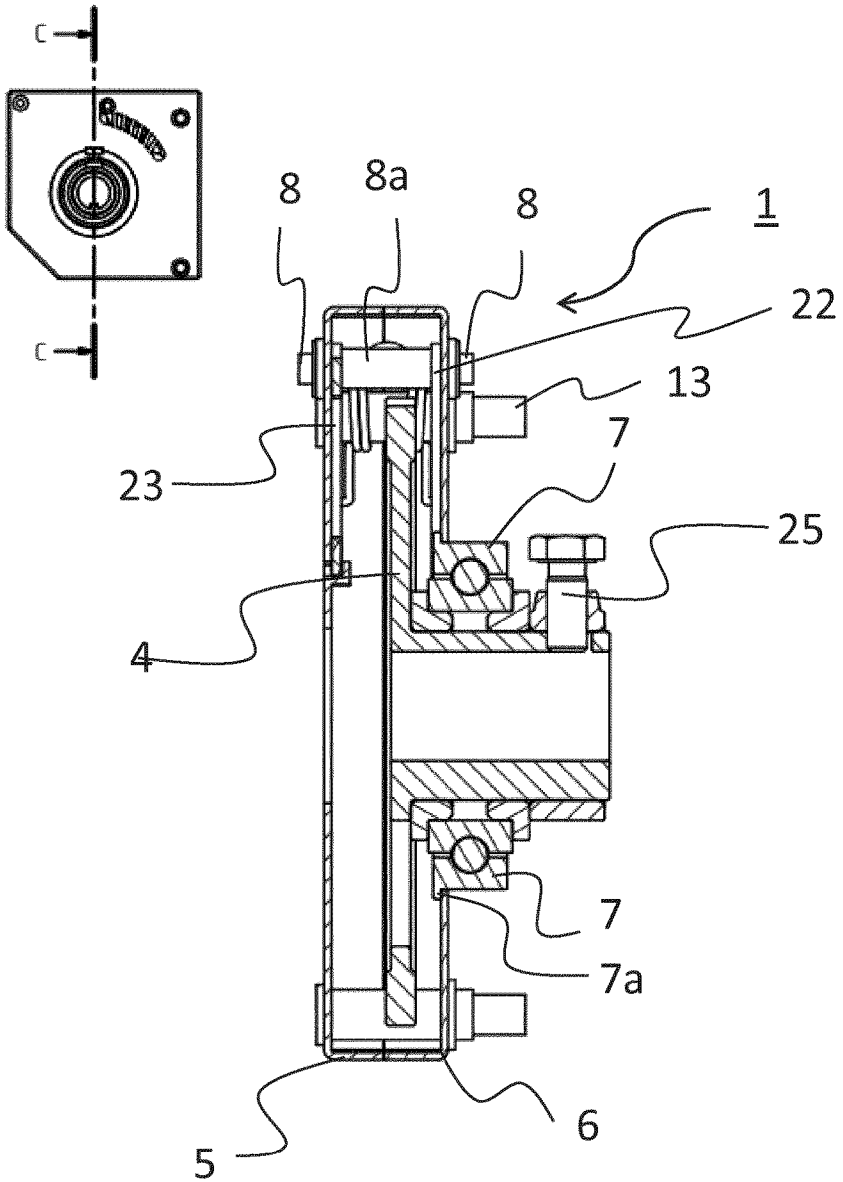
FIG. 10 shows a sectional view of the assembly of FIG. 1.

FIG. 10 shows a sectional view of the assembly of FIG. 1. The sectional view is taken along the line c-c as shown in the small figure in the upper left corner of FIG. 10. The bearing 7 of the bearing and ratchet wheel unit is mounted in the opening 16 formed in the second housing plate 6. As it is indicated by 7*a* in the FIG. 10, an outer bearing ring of the bearing 7 has a flange which connects the bearing 7 to the second housing plate 6, such as by forging, and the bearing may be mounted in the housing by inserting the bearing and ratchet wheel unit from left to right in FIG. 10 until the flange 7*a* abuts against the inner side of the second housing plate 6, after which the first housing plate 5 is connected with the second housing plate 6. An inner bearing ring is secured to the shaft 50 of the ratchet wheel 4 and the ratchet wheel 4 and the housing are dimensioned to allow for a space between the ratchet wheel 4 and the first housing plate 5, which space accommodates the blocking plate 3.

Figure 11:
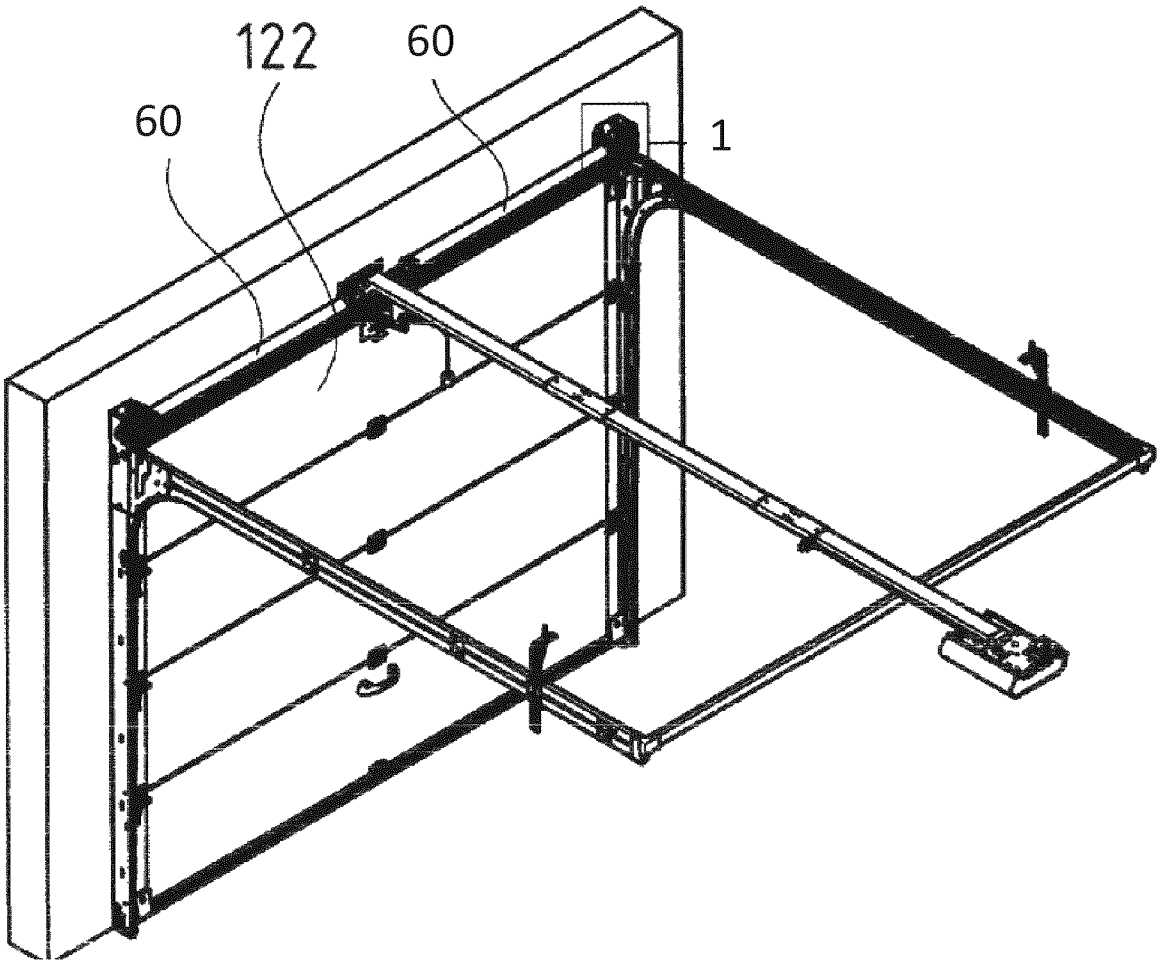
FIG. 11 shows schematically an embodiment of a door system of the present invention, in the form of a sectional door system.

FIG. 11 shows schematically a sectional door system with a sectional door 122 and balancing axle 60 having at each end an assembly 1 as discussed above.

The invention claimed is:

1. An assembly comprising a housing with a balancing spring break protection mechanism, said assembly being configured for connecting a connector of a balancing spring of a sectional door system to said assembly, said housing being for connection with a fixed structure and comprising:

a first housing plate comprising:

an opening for receiving a balancing axle of said sectional door system, said balancing axle being connected to said balancing spring, and an aperture for receiving said connector, said spring break protection mechanism comprising:

a bearing and ratchet wheel unit comprising a rachet wheel, said ratchet wheel including a shaft for receiving said balancing axle, said shaft being connectable with said balancing axle for rotation therewith, a pawl pivotably journaled inside said housing, said pawl being pivotable between a first position in which the ratchet wheel is free-running and a second position in which a pin of the pawl engages the ratchet wheel;

wherein if said connector is rotated said pawl moves into said second position for said engagement with said ratchet wheel so as to limit or prevent rotation thereof, characterized in said housing further comprising:

a second housing plate arranged opposite said first housing plate and connected therewith, said second housing plate comprising an opening receiving said shaft, said ratchet wheel being between said first and second housing plates, said pin of said pawl having a pin head extending through a first pin head opening in said first housing plate or in said second housing plate; and a blocking plate pivotably journaled to the first or second housing plate and arranged between said connector and said pawl, said connector acting on said blocking plate, said blocking plate configured for allowing movement of said pawl from said first position on said rotation of said connector.

2. An assembly comprising a housing with a balancing spring break protection mechanism, said assembly being configured for connecting a connector of a balancing spring of a sectional door system to said assembly, said housing being for connection with a fixed structure and comprising:

a first housing plate comprising:

an opening for receiving a balancing axle of said sectional door system, said balancing axle being connected to said balancing spring, and an aperture for receiving said connector, said spring break protection mechanism comprising:

a bearing and ratchet wheel unit comprising a rachet wheel, said ratchet wheel including a shaft for receiving said balancing axle, said shaft being connectable with said balancing axle for rotation therewith, a pawl pivotably journaled inside said housing, said pawl being pivotable between a first position in which the ratchet wheel is free-running and a second position in which a pin of the pawl engages the ratchet wheel;

wherein if said connector is rotated said pawl moves into said second position for said engagement with said ratchet wheel so as to limit or prevent rotation thereof, characterized in said housing further comprising:

a second housing plate arranged opposite said first housing plate and connected therewith, said second housing plate comprising an opening receiving said shaft, said ratchet wheel being between said first and second housing plates, said pin of said pawl having a pin head extending through a first pin head opening in said first housing plate or in said second housing plate, and further comprising first or second housing plate portions defining a deformation zone yielding by a force applied by said pin head moving in said first pin head opening upon continued rotation of said ratchet wheel engaged by said pawl.

3. The assembly of claim 2, including a number of further pin head openings defining said deformation zone, wherein portions of said first housing plate or of said second housing plate separating said pin head openings from each other will break by said pin head moving from one of said pin head openings to another of said pin head openings upon said continued rotation of said ratchet wheel engaged by said pawl, or said first pin head opening being an elongated passage tapering towards one end and defining said deformation zone by said pin head expanding said passage on moving into portions thereof having a width smaller than the cross-wise dimension of said pin head upon said continued rotation of said ratchet wheel engaged by said pawl.

4. The assembly of claim 2, said housing including at least one wall portion spanning between said first and second housing plates, said housing enclosing said ratchet wheel of said bearing and ratchet wheel unit, said at least one wall portion optionally being integral with said first or second housing plate.

5. The assembly of claim 2, wherein the aperture comprises a plurality of apertures, and wherein ones of the plurality of apertures are adapted to receive connectors of different types or sizes.

6. The assembly of claim 2, including a plurality of said apertures for receiving connectors, wherein at least one of said apertures includes an enlarged portion and a narrow slot.

7. The assembly of claim 2, said connector including a pin with a head for defining a bayonet connection with said aperture receiving said head.

8. The assembly of claim 2, wherein the connector is a bayonet connector.

9. A sectional door system including:

a balancing axle connected with a balancing spring for balancing said sectional door and an assembly with a housing including a balancing spring break protection mechanism, a connector connecting said balancing spring to said assembly, said housing being for connection with a fixed structure and comprising:

a first housing plate comprising:

an opening receiving said balancing axle, and an aperture receiving said connector, said spring break protection mechanism comprising:

a bearing and ratchet wheel unit, comprising a ratchet wheel, said ratchet wheel including a shaft receiving said balancing axle, said shaft being connected with said balancing axle for rotation therewith, a pawl pivotably journaled inside said housing, said pawl being pivotable between a first position in which the ratchet wheel is free-running and a second position in which a pin of the pawl engages the ratchet wheel;

wherein if said connector is rotated relative to said housing said pawl moves into said second position for said engagement with said ratchet wheel so as to limit or prevent rotation thereof, characterized in said housing further comprising:

a second housing plate arranged opposite said first housing plate and connected therewith, said second housing plate comprising an opening receiving said shaft, said ratchet wheel being between said first and second housing plates, said pin of said pawl having a pin head extending through a first pin head opening in said first housing plate or in said second housing plate; and a blocking plate pivotably journaled to the first or second housing plate and arranged between said connector and said pawl, said connector acting on said blocking plate, said blocking plate configured for allowing movement of said pawl from said first position on said rotation of said connector.

10. A sectional door system including:

a balancing axle connected with a balancing spring for balancing said sectional door and an assembly with a housing including a balancing spring break protection mechanism, a connector connecting said balancing spring to said assembly, said housing being for connection with a fixed structure and comprising:

a first housing plate comprising:

an opening receiving said balancing axle, and an aperture receiving said connector, said spring break protection mechanism comprising:

a bearing and ratchet wheel unit, comprising a ratchet wheel, said ratchet wheel including a shaft receiving said balancing axle, said shaft being connected with said balancing axle for rotation therewith, a pawl pivotably journaled inside said housing, said pawl being pivotable between a first position in which the ratchet wheel is free-running and a second position in which a pin of the pawl engages the ratchet wheel;

wherein if said connector is rotated relative to said housing said pawl moves into said second position for said engagement with said ratchet wheel so as to limit or prevent rotation thereof, characterized in said housing further comprising:

a second housing plate arranged opposite said first housing plate and connected therewith, said second housing plate comprising an opening receiving said shaft, said ratchet wheel being between said first and second housing plates, said pin of said pawl having a pin head extending through a first pin head opening in said first housing plate or in said second housing plate, and further comprising first or second housing plate portions defining a deformation zone yielding by a force applied by said pin head moving in said first pin head opening upon continued rotation of said ratchet wheel engaged by said pawl.

11. The system of claim 10, including a number of further pin head openings defining said deformation zone, wherein portions of said first housing plate or of said second housing plate separating said pin head openings from each other will break by said pin head moving from one of said pin head openings to another of said pin head openings upon said continued rotation of said ratchet wheel engaged by said pawl, or said first pin head opening being an elongated passage tapering towards one end and defining said deformation zone by said pin head expanding said passage on moving into portions thereof having a width smaller than the cross-wise dimension of said pin head upon said continued rotation of said ratchet wheel engaged by said pawl.

12. The system of claim 10, said housing including at least one wall portion spanning between said first and second housing plates, said housing enclosing said ratchet wheel of said bearing and ratchet wheel unit, said at least one wall portion optionally being integral with said first or second housing plate.

13. The system of claim 10, wherein the aperture comprises a plurality of apertures, and wherein ones of the plurality of apertures are adapted to receive connectors of different types or sizes.

14. The system of claim 10, including a plurality of said apertures for receiving connectors, wherein at least one of said apertures includes an enlarged portion and a narrow slot.

15. The system of claim 10, said connector including a pin with a head for defining a bayonet connection with said aperture receiving said head.

16. The sectional door of claim 10, wherein the connector is a bayonet connector.

* * * * *